US005464286A

United States Patent [19]

Stevens et al.

[11] Patent Number: 5,464,286

[45] Date of Patent: Nov. 7, 1995

[54] CEILING TILE DUST & DEBRIS CATCHER

[76] Inventors: Sidney V. Stevens; Deborah S. Stevens, both of 1707 Short Pl.; Ronald Bowker, 1037 Townley Cir., all of Longmont, Colo. 80501

[21] Appl. No.: 335,502

[22] Filed: Nov. 7, 1994

[51] Int. Cl.[6] ..... B65D 33/28; B65D 33/14

[52] U.S. Cl. ..... 383/75; 383/11; 383/41; 383/67; 312/1

[58] Field of Search ..... 312/1; 52/39, 63; 135/900; 383/11, 41, 75, 36, 902, 907, 67, 72, 76; 15/345; 134/201

[56] References Cited

U.S. PATENT DOCUMENTS

| | | | |
|---|---|---|---|
| Re. 33,810 | 2/1992 | Strieter | 135/900 X |
| 2,039,490 | 5/1936 | Mikelson | 312/1 |
| 4,633,899 | 1/1987 | Lord | 52/39 X |
| 4,928,348 | 5/1990 | Clayton | 15/345 |
| 4,953,704 | 9/1990 | Cortese . | |
| 5,062,871 | 11/1991 | Lemon, III | 312/1 X |
| 5,088,511 | 2/1992 | Bain | 312/1 X |
| 5,092,681 | 3/1992 | Ashley, III . | |
| 5,121,776 | 6/1992 | Kovach | 383/41 X |
| 5,160,230 | 11/1992 | Cuevas . | |

*Primary Examiner*—Jes F. Pascua

[57] ABSTRACT

A dust and debris collection system for suspended ceiling tiles made up of a slightly cylindrical shaped plastic bag (10) having a rounded drawstring (14) opening at one end and a rectangular opening at the top end which is attached to adhesive tape strips (12). The dust and debris collection system is connected to a suspended ceiling tile grid at the top rectangular end by means of adhesive tape strips (12) and the drawstring (14) is snugged to the waist of a worker inside the bag (10) while he/she is working above the ceiling and will catch any falling dust or debris.

2 Claims, 1 Drawing Sheet

CEILING TILE DUST & DEBRIS CATCHER

BACKGROUND—FIELD OF THE INVENTION

This invention relates to the collection of dust and debris that accumulates above suspended ceiling tiles and then falls out when the tile(s) need to be moved or changed.

BACKGROUND—DESCRIPTION OF PRIOR ART

We were unable to find any prior art for this invention. There are debris catchers that attach to tools like drills and saws (for example, U.S. Pat. No. 5,160,230 issued 1992), but none that attach to suspending ceiling grids. There are all kinds of plastic trash bag systems with drawstrings or other closures (for example U.S. Pat. No. 5,090,681 issued 1992), but none that are open at both ends, or designed with a drawstring to go around a worker's waist while he is working inside the bag.

OBJECTS AND ADVANTAGES

Accordingly, several objects and advantages are:

(a) By placing the bottom drawstring around the worker's waist and having the larger open end attached to the grid for the ceiling tiles, no debris or dust is allowed to fall on persons or objects below.

(b) Clean up after changing or removing a ceiling tile is minimal since all the dust and debris is contained inside the bag.

(c) People working in the same environment where the ceiling tile is being moved will not be breathing the dust or debris that would fall from above the ceiling tile.

(d) The dust and debris catcher would also be used when workers are changing the lights in a suspended ceiling.

Further objects and advantages of this invention will become apparent from a consideration of the drawings and ensuing description.

DRAWING FIGURES

The invention will be better understood by reference to the accompanying drawing, wherein.

REFERENCE NUMERALS IN DRAWINGS

10 Plastic bag with side seam(s), one rounded open end with drawstring, and one rectangular open end adhered to adhesive tape.

12 Adhesive tape adhered to bag 10 on one side and with peelable paper pull tabs on the other side.

14 Drawstring of rope, cord, or plastic. DESCRIPTION—

FIGS. 1 TO 4

Figure 1:
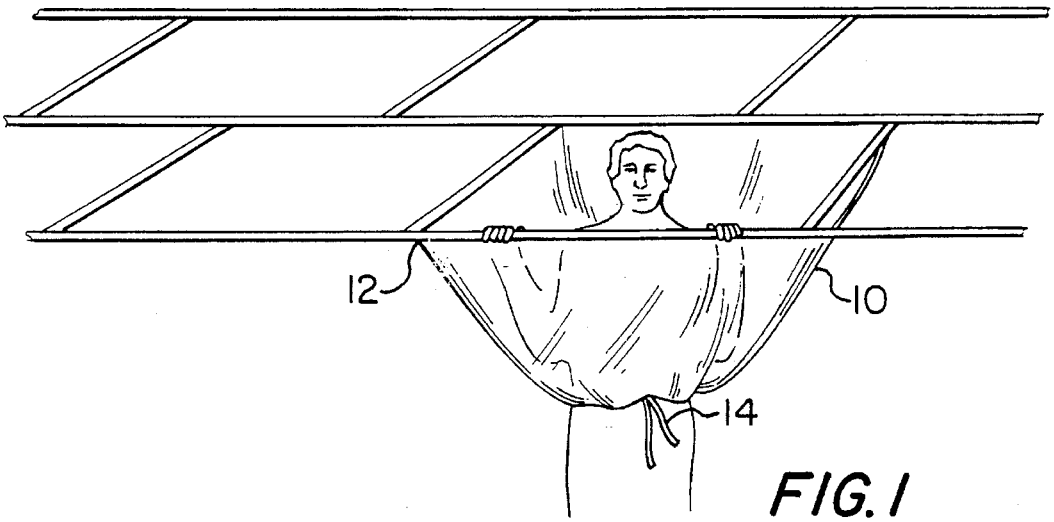
FIG. 1 is a perspective view of the ceiling tile dust and debris catcher attached to the suspension grid for ceiling tiles and also attached to the worker's waist. The worker is inside the dust and debris cather from the waist up.
Figure 2:
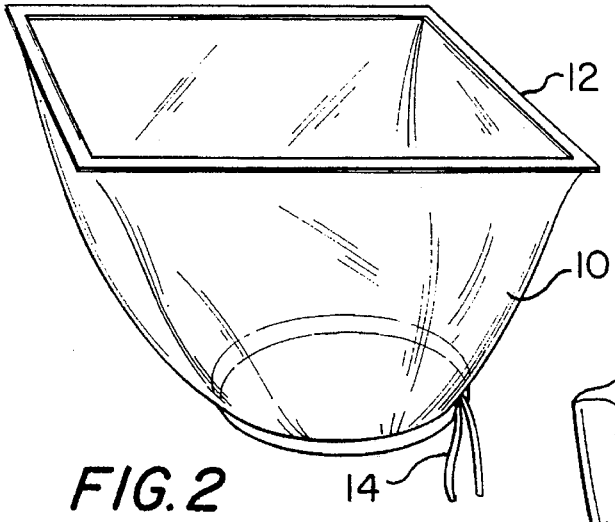
FIG. 2 is a perspective drawing of the Ceiling Tile Dust and Debris Catcher in planar, deployed configuration ready to be attached to a suspended ceiling grid and the waist of a worker.
Figure 3:
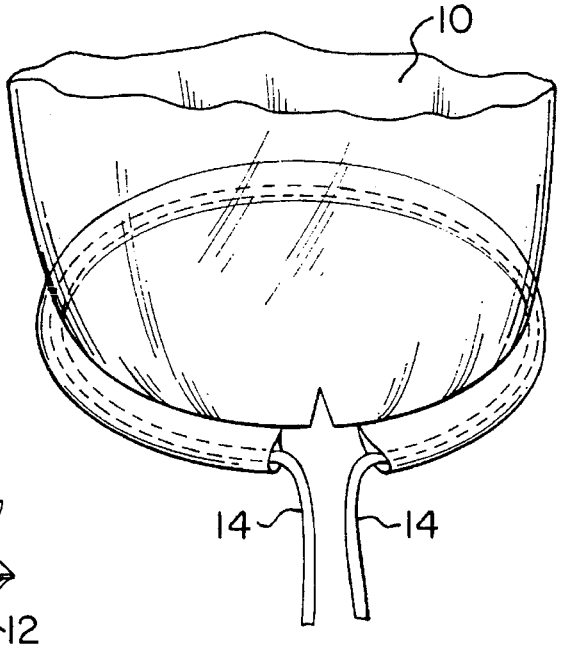
FIG. 3 is an enlarged sectional view of the drawstring configuration of the Ceiling Tile Dust and Debris Catcher illustrated in FIG. 1 and FIG. 2.
Figure 4:
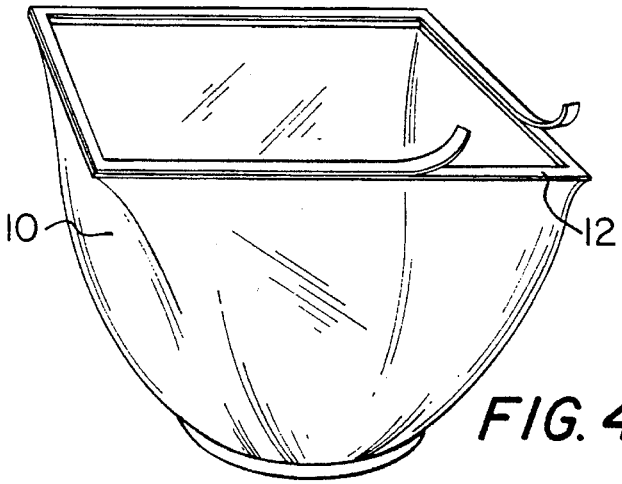
FIG. 4 is an enlarged sectional view of the double-sided adhesive tape configuration which is adhered to the plastic bag 10 on one side and with peelable paper pull tabs on the other side as illustrated in FIG. 1 and FIG. 2.

FIGS. 1 and 2 of the drawings show the preferred embodiment of the Ceiling Tile Dust and Debris Catcher. FIG. 3 shows the details of how the drawstring 14 is encased the the lower end of the plastic bag 10. FIG. 4 shows the details of how the rectangular end of the plastic bag 10 is attached to the double-sided adhesive tape 12 with a paper covering on the opposite side that can be peeled off just prior to use. The adhesive strip will be attached to the suspended ceiling grid as shown in FIG. 1

While the preferred embodiments of the invention have been described above, it will be recognized and understood that various modifications may be made therein and the appended claims are intended to cover all such modifications which may fall within the spirit and scope of the invention.

OPERATION—FIGS. 1 TO 4

The manner of using the Ceiling Tile Dust and Debris Catcher is to remove the paper pull tabs from the adhesive tape 12 and attach to the suspended ceiling metal grid frame. The worker then steps up inside the bag 10 with any necessary tools. The worker then pulls the drawstring 14 tightly around his waist, raises the ceiling tile and completes whatever task needs to be done above the suspended ceiling. When the task is finished, the tile is repositioned, the worker removes the bag 10 from the ceiling grid catching all dust and debris inside the bag 10.

SUMMARY, RAMIFICATIONS, AND SCOPE

Accordingly, the reader will see that this Ceiling Tile Dust and Debris Catcher invention will be very useful in many buildings with suspended ceilings. It permits workers to change or move ceiling tiles with a minimum of disruption and discomfort to other people in the area.

While the description above contains many specifications, these should not be construed as limitations on the scope of the invention, but rather as an exemplification of one preferred embodiment thereof. Many other variations are possible. For example, the bag 10 is characterized by a flexible plastic sheet similar to a large trash bag; however, it may also be made of canvas, rubber, cloth, vinyl, ripstop nylon, or any other flexible material. The bag 10 may also be constructed with pockets or pouches on the inside. The bag 10 may also be constructed with a double drawstring, or with elastic, or with special tabs inside for holding light bulbs. The rectangular end of the bag 10 may also be attached to the ceiling grid with other suspending means such as magnets or hook and pile fasteners sold under the trademark VELCRO. Accordingly, the scope of the invention should be determined not by the embodiments illustrated, but by the appended claims and their legal equivalents.

We claim:

1. A dust and debris collection system comprising:

(a) a bag of pliable material having a rounded, open end and an opposing rectangular, open end, with each open end defining a perimeter, (b) said rounded, open end including a drawstring surrounding its perimeter, whereby the drawstring permits gathering of the rounded, open end about the waist of a user, and (c) said rectangular, open end includes a suspending means completely surrounding its perimeter, whereby the rectangular, open end is attachable to a metal grid of a suspended ceiling.

2. The dust and debris collection system set forth in claim 1 wherein said suspending means includes a double-sided adhesive tape with one side of the adhesive tape being adhered to said rectangular, open end and the other side of the adhesive tape having pull tabs, whereby the pull tabs are peelable from the adhesive tape in order to permit suspension of the bag from its rectangular, open end.

* * * * *